United States Patent [19]

Chiarolanzio

[11] Patent Number: 5,069,634

[45] Date of Patent: Dec. 3, 1991

[54] SNAP LOCK EXTENSION CORD AND POWER TOOL CONNECTOR

[76] Inventor: Martin J. Chiarolanzio, 21 Keep St., Madison, N.J. 07940

[21] Appl. No.: 646,073

[22] Filed: Jan. 24, 1991

[51] Int. Cl.[5] ..... H01R 13/627

[52] U.S. Cl. ..... 439/353; 439/373

[58] Field of Search ..... 439/350, 352–354, 439/357, 358, 106, 373

[56] References Cited

U.S. PATENT DOCUMENTS

| | | | |
|---|---|---|---|
| 1,835,251 | 12/1931 | Wetstein . | |
| 2,291,793 | 8/1942 | Chandler . | |
| 2,728,058 | 12/1955 | Phalen | 439/373 |
| 3,192,499 | 6/1965 | West . | |
| 3,316,523 | 4/1967 | Trangmar . | |
| 4,526,431 | 7/1985 | Kasukawa | 439/153 |
| 4,531,800 | 7/1985 | Avener | 439/373 |
| 4,603,931 | 8/1986 | Ruffman | 439/373 |
| 4,643,505 | 2/1987 | House . | |
| 4,900,261 | 2/1990 | Gentry et al. | 439/353 |
| 4,907,984 | 3/1990 | Keller | 439/369 |
| 4,917,625 | 4/1990 | Haile | 439/538 |
| 4,917,627 | 4/1990 | Hendricks | 439/357 |
| 4,998,891 | 3/1990 | Bresko | 439/369 |

*Primary Examiner*—Larry I. Schwartz

*Assistant Examiner*—Hein D. Vu

*Attorney, Agent, or Firm*—Kenneth P. Glynn

[57] ABSTRACT

The present invention is directed toward an electrical connection device that positively engages the plug and receptacle ends of electrical devices to extension cords, adjacent extension cords, or positively engages an electrical cord with a power receptacle. The invention is formed so that either the receptacle or plug end of an extension cord or the cover of an electrical outlet has at least one flexible finger, depending on its front surface. The extension cord end or the electric appliance plug engaging the flexible finger has an orifice on its face shaped to accept the flexible finger. As the plug and receptacle ends are pushed together, the flexible finger enters the face orifice. The flexible finger has a locking tab formed as part of its tip. As the flexible finger advances within the opposing face orifice, the locking tab eventually comes into contact with a side orifice. The locking tab, encouraged by the bias of the flexible finger, enters the side orifice. The interference of the side orifices edges against the locking tabe and prevents the flexible finger from withdrawing from the face orifice, thus positively engaging the plug and receptacle. The receptacle and plug are disengaged by deforming the locking tab below the side orifice and pulling the flexible finger from the face of the orifice.

15 Claims, 3 Drawing Sheets

SNAP LOCK EXTENSION CORD AND POWER TOOL CONNECTOR

BACKGROUND OF THE INVENTION

1. Field of the Invention

The present invention is directed toward an electrical connecting device, and more particularly to such connectors that positively engage the plug of an electrical appliance to an extension cord, the plug and receptacle ends of adjacent extension cords, or the plug of an electrical cord to a power outlet, preventing disconnection during tensile stresses and allowing for disconnection only through the manual manipulation of an orientational bias that exists between the plug and receptacle or outlet.

2. Prior Art Statement

Since the advent of electrical appliances and tools, man has had the same recurring problem. The existing plug on the electrical appliance does not reach an electric outlet. This problem was quickly remedied by the invention of the extension cord. However, electrical devices, especially electrical tools, are often moved when operated. This movement stresses the connection between the electrical device and the extension cord, resulting in a premature disconnection. Similarly, when one extension cord does not add the needed length, a series of extension cords are needed to connect an electrical appliance to an outlet. Most people prefer short extension cords to long because the future need for extension cords cannot be foreseen, and since short extension cords can be interconnected to create a long extension cord, shorter extension cords give more versatility and fit more applications than does a long cord. The problem with short extension cords that are combined to create a long cord, is that the points of interconnection between the short cords often become disconnected when the extension cords are pulled. Also, the interconnection points between short cords often bind on objects as the extension cord is moved, the binding causing tensile stress which ultimately causes the disconnection of the shorter cords.

The tendency of interconnected extension cords to bind and disconnect is a well known problem, and over the years many different inventions have been developed to prevent such an occurrence. The prior art which exemplifies the varying types of inventions is as follows:

U.S. Pat. No. 2,291,793 to Chandler shows a receptacle/plug connecting device that uses a hook to secure the plug and receptacle together. The hook prevents the plug and receptacle from pulling apart but the hook can easily become undone as the plug and receptacle are rotated and otherwise manipulated during use:

U.S. Pat. No. 4,907,984 to Keller shows a receptacle and plug that are held together by a strap and buckle, the strap being twisted around the wires of each side. The attachment, removal and use of this invention requires considerable amount of time and effort;

U.S. Pat. No. 3,316,523 to Trangmar shows a plug and receptacle held together by the bias of a leaf spring. The spring biased connection can be defeated if the leaf spring binds against an object during use, or if the spring connection is subject to varying impacts. In such a situation, the plug and receptacle may disengage and the spring bias holding them together may come free and be lost.

U.S. Pat. No. 1,835,251 to Wetstein shows a plug and receptacle held together by clamps. The biasing of the clamps can be easily defeated if the clamp tabs bind or hit upon an object during use.

U.S. Pat. No. 4,917,625 to Haile shows an independent middle piece that connects the plug and receptacle. However, since extension cords are only used periodically and the Haile invention is a small independent piece, it is likely that the Haile invention would be lost, eliminating the binding characteristics of the two extension cords. Also, in large construction sites, where many extension cords are used, there is no way to assure that the Haile invention will be removed and reengaged properly each time the extension cords are used.

U.S. Pat. No. 4,643,505 to House et al, shows a device that envelops the receptacle and plug ends of two extension cords. The receptacle and plug are anchored in place by obstructions that descend from the enveloping encasement. The House patent also exemplifies the first type of engagement device that has a streamlined shape to diminish the binding characteristics of joined cords;

U.S. Pat. No. 3,192,499 to West shows a receptacle and plug wherein one has a flexible finger that engages a relief within the wall of the other. The flexible finger not only ensured a positive engagement but orients the plug and receptacle for proper connection. The flexible finger is attached to the side periphery of the male plug, which is entirely enveloped by the female receptacle. The flexible finger also has a tab extending from it that does not become enveloped by the receptacle. The tab is depressed to deform the flexible finger when the plug and receptacle are to be disconnected.

Thus, although prior art does teach the use of devices that positively engage the plug and receptacle ends of electrical devices and extension cords or adjacent extension cords, prior art does not teach nor suggest an electrical plug engagement device that is streamlined to prevent binding, formed to stay engaged regardless of movement during use, and unistructurally manufactured as part of the plug and receptacle. As such, no prior art anticipates the novel device developed herein.

Similar to the problem of extension cords becoming disconnected is the problem of electrical cords disconnecting from wall sockets. The same technology that is used to interconnect adjacent electrical cords can be designed into the cover of wall sockets and into the plug ends of electrical appliances and power tools. Such a design prevents a plug from becoming desconnected when such an electrical device is moved and the cord is stressed. Similarly, since prior art neither teaches nor suggests the present invention in use to connect electrical devices to extension cords, adjacent electrical extension cords, prior art neither teaches nor suggests the use of the present invention to connect electrical cords to wall receptacles.

SUMMARY OF THE INVENTION

The present invention is directed toward an electrical connection device that positively engages the plug and receptacle ends of electrical devices to extension cords, adjacent extension cords, or positively engages an electrical cord with a power receptacle. The invention is formed so that either the receptacle or plug end of an extension cord or the cover of an electrical outlet has at least one flexible finger, depending on its front surface. The extension cord end or the electric appliance plug engaging the flexible finger has an orifice on its face shaped to accept the flexible finger. As the plug and receptacle ends are pushed together, the flexible finger enters the face orifice. The flexible finger has a locking tab formed as part of its tip. As the flexible finger advances within the oposing face orifice, the locking tab eventually comes into contact with a side orifice. The locking tab, encouraged by the bias of the flexible finger, enters the side orifice. The interference of the side orifices edges against the locking tab and prevents the flexible finger from withdrawing from the face orifice, thus positively engaging the plug and receptacle. The receptacle and plug are disengaged by deforming the locking tab below the side orifice and pulling the flexible finger from the face orifice.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE PRESENT INVENTION

Figure 1:
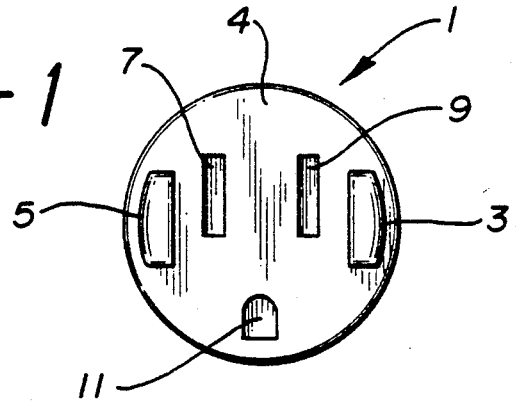
FIG. 1 shows a front view of one preferred embodiment of the present invention as designed into the receptacle end of an extension cord.

The present invention is, as mentioned, directed towards an electrical connecting device that positively engages the plug and receptacle ends of an electrical device and an extension cord, adjacent extension cords or connects plugs to wall receptacles. Over the years, extension cords have been used to help power almost every electrical device ever created. Often, the electrical device a person wants to use may be carried a long way away from an electrical outlet. In such situations, an extension cord is used. However, if the electrical device is moved when operated, such as with a power tool, the movement can stress the connection between the electrical device and the extension cord, resulting in a premature disconnection. Similarly, a person may find that one extension cord will not span the desired distance. As such, multiple extension cords must be interconnected, creating one large cord. There are two major problems that occur when electrical cords are interconnected. First, the point of interconnection between electrical cords is very sensitive to tensile stresses, causing the cords to disconnect. The problem is amplified when the interconnected extension cords are used to travel a height, and the weight of the cords tends to cause the cords to disconnect. The problem also often occurs when a long, multiconnected cord is moved by the user of an electrical device. The inertia of the long cord resists the movements by the user, causing tensile stresses that pull cord connections apart.

The second problem that occurs with interconnected extension cords is that the point of interconnection between cords often binds against edges and within openings, as the electrical cords are pulled past objects during use. The binding causes a large tensile stress as the user pulls on the electrical cords to overcome the binding. The result is that the cords often become disconnected at the connection, which is causing the binding.

Similar problems occur when electrical appliances and tools are attached directly to wall receptacles. On items such as power tools, hair dryers, irons and the like, the user is constantly moving the electrical device. This constant movement stresses the interconnection between the plug and the power receptacle and results in an intermittent connection or a disconnection.

Many inventors have recognized the problems of unwanted disconnections and binding, and dozens of different inventions have been developed as a result. However, no device yet developed eliminates the inherent problems of interconnected plugs and receptacles as effectively as the present invention. The present invention is a two-piece device that substitutes for the plug end of electrical devices, the plug and receptacle ends of existing or newly manufactured extension cords, or substitutes for electrical device plugs and wall receptacle covers. Since the plug ends of extension cords and electrical device cords have a life expectancy usually much shorter than the wire they interconnect, the plug and receptacle ends of extension cords and the plug of electrical devices are often manufactured to be removable. Once removed, the present invention plug and receptacle ends can be added, thus giving the benefits of the present invention to any existing plurality of extension cords or electrical devices at a minimal cost.

Figure 2:
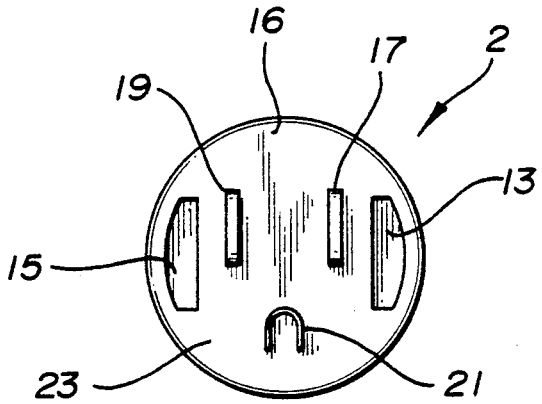
FIG. 2 shows a front view of one preferred embodiment of the present invention as designed into the plug end of an extension cord and formed complimentary to the embodiment of FIG. 1.

Referring now to FIG. 1 through 5, there is shown one preferred embodiment to the present invention. FIG. 1 shows a forward view of an extension cord female receptacle 1 having a body member with as forward face 4, flexible finger extensions 5, 3, power receptacles 7, 9 and a ground receptacle 11. FIG. 2 shows the front view of a complementary plug and termination 2 having a body member with a front face 16, power leads 19, 17, ground lead 21, and two finger receptacle orifices 15 and 13.

Figure 3:
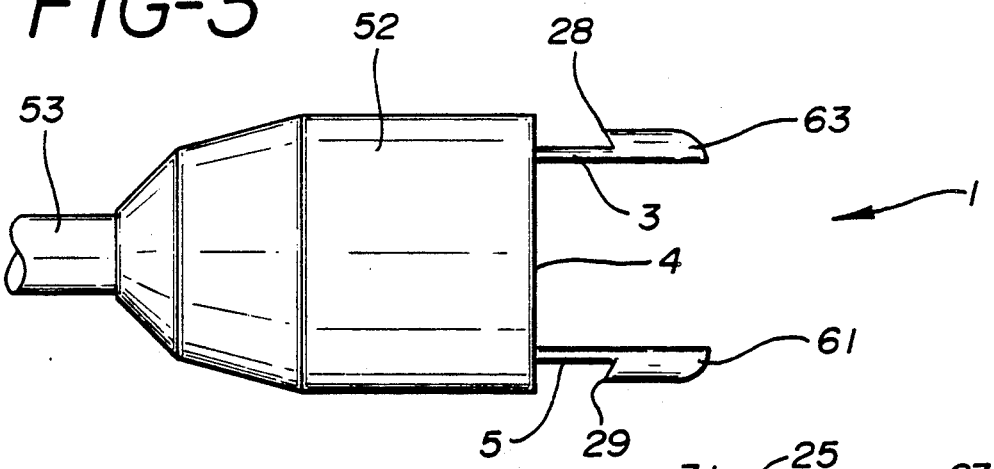
FIG. 3 shows a top view to the embodiment depicted in FIG. 1.
Figure 4:
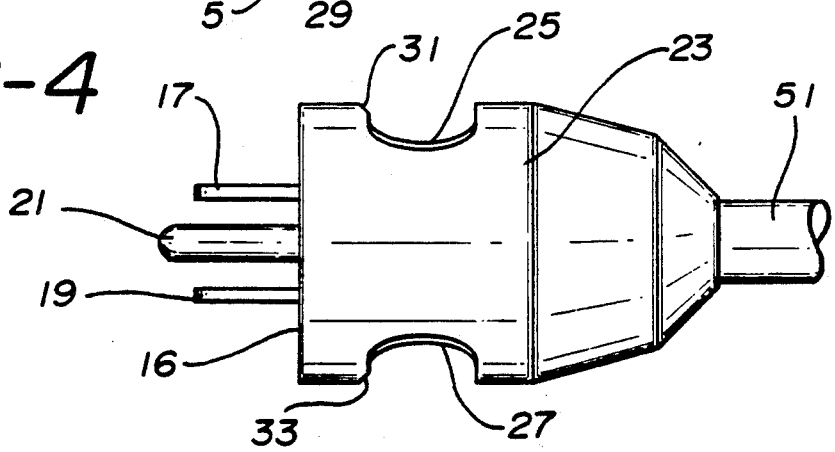
FIG. 4 shows a top view to the embodiment depicted in FIG. 2.

FIG. 3 shows a top view of the female receptacle and termination 1 and illustrates the best view of the flexible finger extensions 3, 5. As shown in this embodiment, each flexible finger extension 3, 5 has a thickened end, creating a locking tab 63, 61 that meets with the outer surface of the fingers 3, 5 at an angle of less degrees. FIG. 4 is a top view of the complementary male plug end termination 2 showing the side orifices 25, 27 through which the locking tabs 63, 61 will pass. FIG. 4 also shows the forward walls 31, 33 that are angled to match the angle between the locking tabs 28, 29 and the flexible fingers 3, 5.

Figure 5:
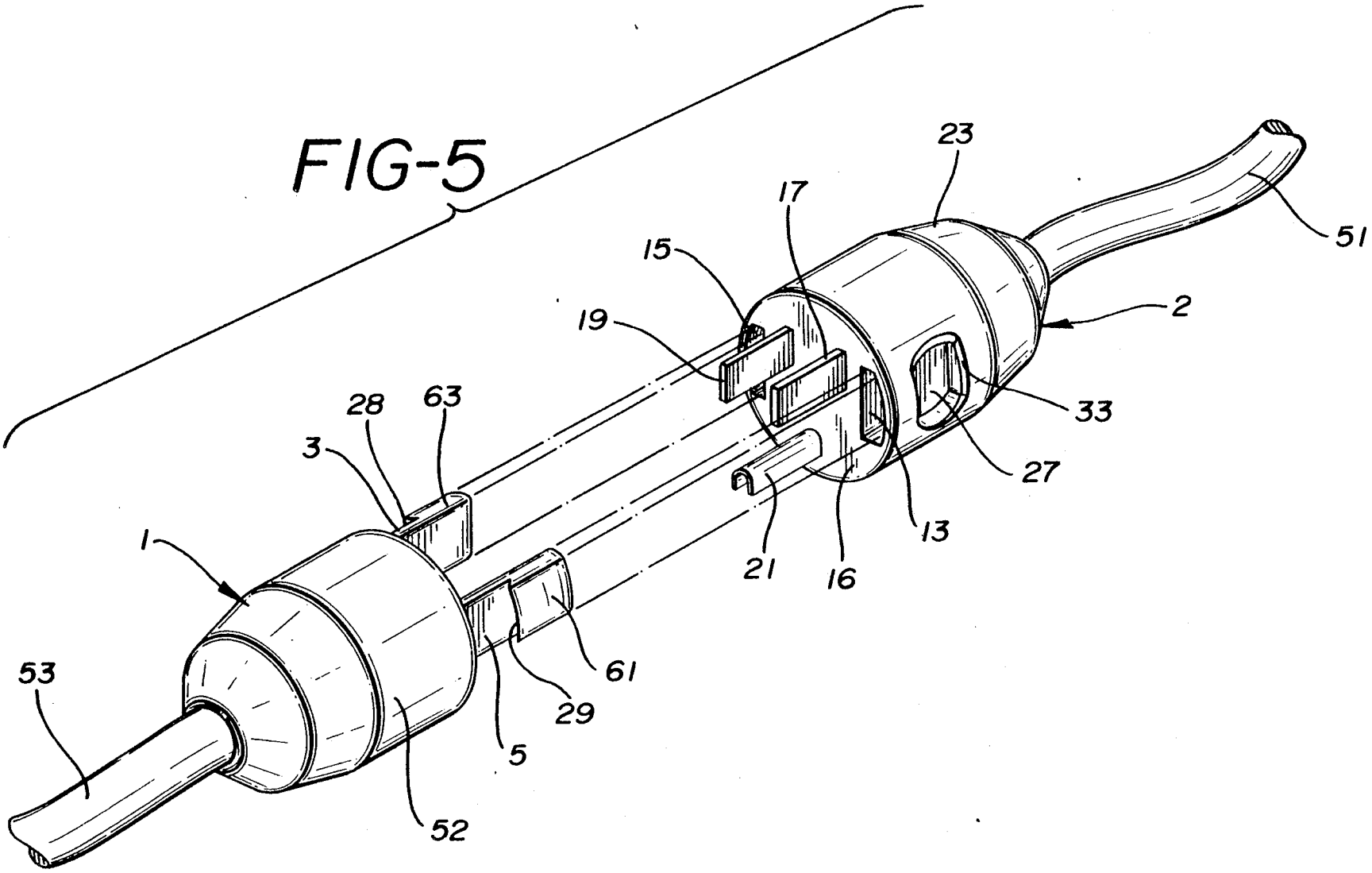
FIG. 5 shows a prospective view of the embodiment shown in FIGS. 1, 2, 3 and 4 sf.

Referring now to FIG. 5 in conjunction with FIGS. 1 through 4, the operation of the shown embodiment to the present invention can best be explained. The receptacle end termination 1 is affixed to a first extension cord wire 53. Similarly, the plug end termination 2 is attached to a second extension cord wire 51, the objective of the invention being attaching wire 51 to wire 53 in such a manner so that a tensile force will not separate the connection. The receptacle end termination 1 and the plug end termination 2 interconnect in the following manner. As the front surface 16 of the plug end termination 2 is aligned and drawn against the front surface 4 of the receptacle end termination 1, the flexible finger extensions 3, 5 enter the finger receptacle orifices 14, 13 as the power leads 19, 17 enter the power lead receptacles 9, 7 and the ground lead 21 enters the ground receptacle 11. Normally, on extension cord interconnections not embodying the present invention, it is the frictional forces of the power leads 19, 17 and the ground lead 21 within the power lead receptacles 9, 7 and ground receptacle 11 that hold the two extension cords together in resistance to a tensile stress. In the present embodiment, the flexible finger extensions 3, 5 terminate in locking tab extensions 63, 61. The locking tab extensions 63, 61 enter into the finger receptacle orifices 15, 13 until the locking tab extensions 63, 61 encounter the side orifices 25, 27. When the full length of the lock tab extensions 63, 61 pass within the region of the side orifices 25, 27 the spring bias of the flexible fingers 3, 5 forces the locking tab extensions up into the side orifices 25, 27. The passage of the locking tab extensions 63, 61 into the side orifices 25, 27 is calculated to occur just prior to the engagement of the front face 16 of the plug end termination 2 with the front face 4 of the receptacle end termination 1.

In the embodiment shown, the locking tab extensions 63, 61 make an acute angle with the flexible fingers 3, 5. The acute angle results in reliefs 29, 28 being formed at the bases of the locking tab extensions 63, 61. Similarly, forward walls 31, 33 of the orifices 25, 27 are so formed as to engage the shape of the locking tab reliefs 29, 28. Once the locking tab extensions 63, 61 are within the side orifices 25, 27, the forward walls 31, 33 of the side orifices 25, 27 face the reliefs 29, 28 of the locking tab extensions 63, 61. When as tensile force is applied between plug end termination 2 and receptacle end termination 1, the reliefs 29, 28 of the locking tab extensions 63, 61 are forced against the forward walls 31, 33 of the orifices 25, 27, causing the two surfaces to engage the form of the other. This engagement prohibits the locking tab extensions 63, 61 from moving up or down within the side orifices 25, 27. Once engaged, tensile force applied between electrical cords 51, 53 will be resisted by the locking tab extensions 63, 61 interference with the side orifice forward walls 31, 33, increasing the maximum tensile force without disconnection from under five pounds to over one hundred pounds.

To disengage the invention and disconnect the two electric cords 53, 51, the plug end termination 2 is compressed against the receptacle end termination 1. The compression forces the locking tab extensions 63, 61 away from the forward edges 31, 33 of the side orifices 25, 27. Once the locking tab extensions 63, 61 are separated from the forward edges 31, 33, the locking tab extensions 63, 61 can be pressed downward into the side orifices 25, 27. Once the locking tab extensions are completely below the area of the side orifices 25, 27, the locking tab extensions 63, 61 and attached flexible fingers 3, 5 can be withdrawn from the finger receptacle orifices 14, 13 by applying a tensile force between the plug and termination 1 and the receptacle and termination 2. The connection and disconnection process is nondestructive to any part, thus the cycles of connection and disconnection can be repeated indefinitely.

Aside from the improved tensile characteristics of the present invention, the present invention minimizes the potential for the creation of tensile forces by streamlining the interconnection point between two electrical cords. The connection of the electrical cords 53, 51 to the plug end termination 2 and the receptacle end termination 1 is tapered, leaving no edges on which the invention may bind as it is moved during use. Additionally, when the locking tab extensions 63, 61 are within the side orifices 25, 27, the locking tab extensions 63, 61 do not extend beyond the circumferential surface of the plug end termination 2. As a result, the locking tab extensions 63, 61 cannot bind on any passing object and the locking tab extensions 63, 61 are protected from being accidentally hit, damaged or disengaged during use.

Although FIGS. 1 through 3 show an embodiment of the present invention that has two flexible fingers 3, 5 on the receptacle end termination 1, and two finger receptacle orifices 25, 27 on the plug end termination 2, it should be understood that any plurality can be used and that pluralities of flexible fingers and finger receptacle orifices can exist on the same surface. It should also be understood that the locking tab extensions 63, 61 and the semi-flexible fingers 3, 5 can be created in many different shapes and orientations without changing the function of the claimed invention.

The present invention can be added to existing electrical appliance cords or extension cords or manufactured directly onto new cords. As such, the present invention may be capable of disassembly for the adaptation to an existing electrical cord, or may be molded as one unistructural piece directly onto a cord during the manufacturing process. Obviously, numerous modifications, variations and combinations of the present invention are possible, in light of the above teachings. It is therefore understood that numerous materials can be used to create the present invention, and the invention may be practiced other than as specifically described or illustrated herein.

Figure 6:
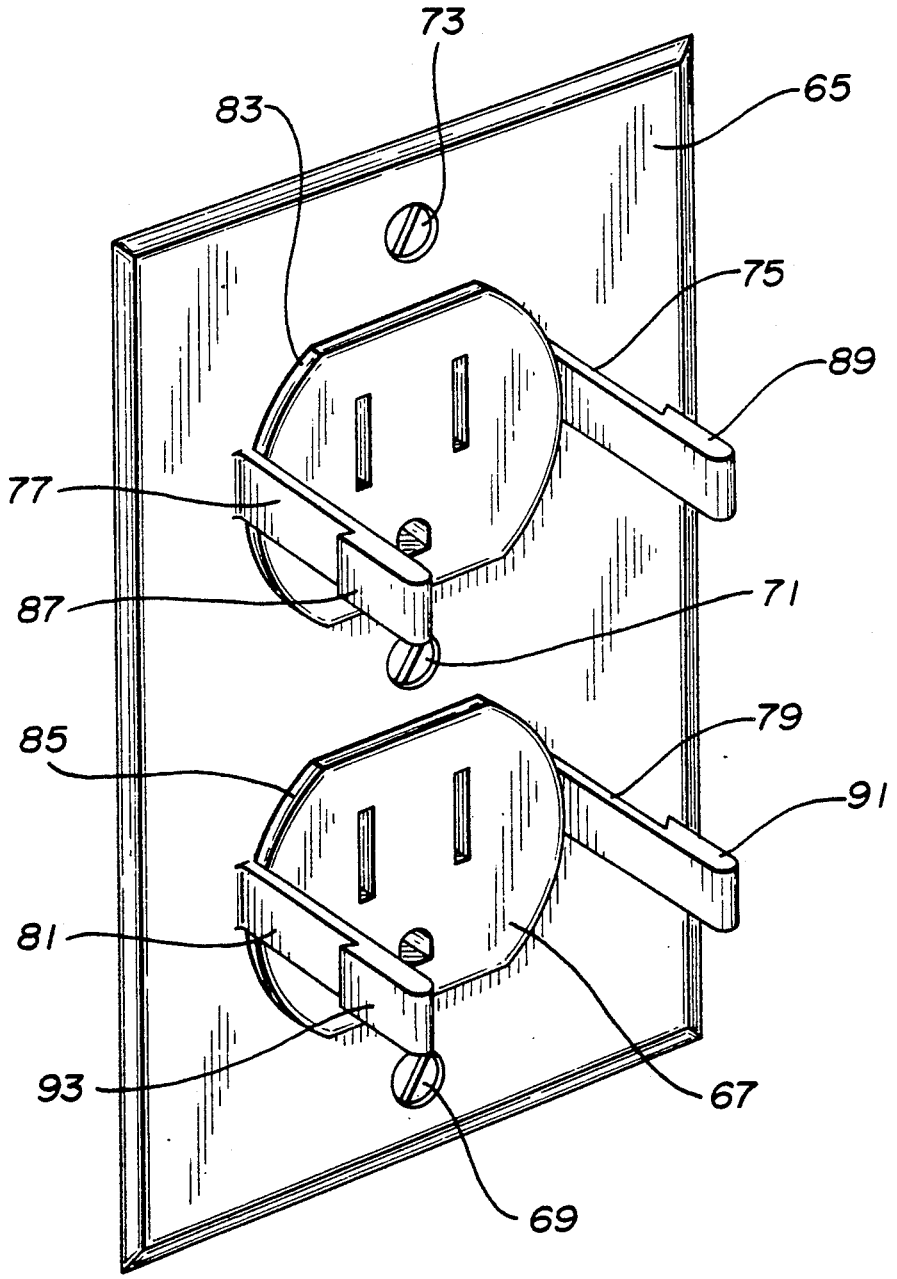
FIG. 6 shows a perspective of an alternative embodiment to the present invention as used on an electrical receptacle cover.

Referring lastly to FIG. 6, there is shown a second embodiment to the present invention. FIG. 6 shows a typical wall receptacle 67 covered by a cover 65 on which is formed one-half of the present invention. The cover 65 has two flexible fingers 77, 75, 81, 79 extending from the sides of each head of the receptacle 67. These flexible fingers 77, 75, 81, 79, although shown to be protruding from the sides of each head of the receptacle 67, may be formed to partially overlap each head of the receptacle 67. Each flexible finger 77, 75, 81, 79 of the shown embodiment is formed with the same characteristics as previously shown and enumerated in FIGS. 1, 3 and 5, with each flexible finger having a locking tab extension 87, 89, 93, 91 thereupon. The flexible fingers 77, 75, 81, 79 engage a plug 2 such as is shown in FIGS. 2, 4 and 5.

The embodiment shown in FIG. 6 is a wall receptacle cover. The cover 65 will be stressed away from receptacle 67 as a plug (not shown) applies tensile stresses to the flexible fingers 77, 75, 81, 79. Normally, a wall receptacle cover 65 is held onto a receptacle 67 through a central attachment screw 71. The embodiment shown in FIG. 6 uses two optional screws 73, 69 in addition to the central screw 71. The optional attachment screws 73, 69, hold both the cover 65 and the receptacle 67 to the electrical outlet box with a wall. The optional attachment screws 73, 69 help the central attachment screw 71 resist the tensile forces applied to the flexible fingers 77, 75, 81, 79, limiting the stress on the plastic cover 65 around the central screw 71.

The engagement, locking and disengagement of the embodiment shown in FIG. 6 with a plug is identical to the engagement, locking and disengagement previously described between plug 2 and the receptacle 1 shown in FIGS. 1 through 5.

Although the embodiment shown in FIG. 6 has four flexible fingers 77, 75, 81, 79, it should be understood that any plurality of fingers can be used so long as the plug is so formed as to engage the plurality of fingers. Additionally, the length, size and orientations of this invention may be formed otherwise than is illustrated, thus, in light of the above teachings it should be understood that the present invention can be practiced other than as specifically described.

What is claimed is:

1. A two-piece electrical cord termination and connection device for temporarily connecting a first and second electrical cord, said device comprising:

(a) a first and second body member, each said body member having at least one substantially planar face surface;

(b) at least one semi-flexible finger extending substantially perpendicularly from said face surface of said first body member, said finger having at least one side surface, wherein said side surface has a locking tab extension protruding therefrom;

(c) at least one finger receptacle orifice on said face surface of said second body member, said receptacle orifice being so formed as to allow for the passage of said semi-flexible finger and said locking tab extension therethrough; and (d) at least one side orifice formed within the side of said second body member, said side orifice intersecting said finger receptacle orifice, and said side orifice being at least as large as said locking tab, wherein said finger receptacle orifice on said face surface of said second body member aligns with said semi-flexible finger of said first body member and said locking tab extension protruding from said flexible finger of said first body member interferes with the passage of said flexible finger into said finger receptacle orifice of said second body member, said interference being removed by the deformation of said semi-flexible finger in a direction opposite said locking tab extension, until both said semi-flexible finger and said locking tab extension align with said finger receptacle orifice, such that said deformation of said semi-flexible finger creates a spring bias within said semi-flexible finger in resistance to said deformation and wherein said locking tab extension has at least one side edge surface that faces said face surface of said first body member, said side edge surface having a relief formed therein.

2. The device of claim 1, wherein said side orifice of said second body member has at least one peripheral edge formed to engage said relief of said locking tab extension side edge surface of said first body member.

3. The device of claim 2, wherein said locking tab extension does not extend beyond said side orifice when said locking tab extension is within said side orifice.

4. The device of claim 2, wherein said face surface of said first body member is the same size as said face surface of said second body member.

5. The device of claim 2, wherein said locking tab extension, said semi-flexible finger and said first body member are unistructurally formed as a singe piece.

6. The device of claim 2, wherein at least one said peripheral edge of said side orifice of said second body member engages said relief of said locking tab extension side edge surface of said first body member when said locking tab extension is within said side orifice and a tensile force exists between said first and second body members.

7. The device of claim 6, wherein the engagement of said relief of said locking tab extension with said peripheral edge of said side orifice prevents the movement of said locking tab within said side orifice.

8. The device of claim 2, wherein said first body member has a tapered end that meets said first electrical cord.

9. The device of claim 8, wherein said second body member has a tapered end that meets said second electrical cord.

10. The device of claim 7, wherein said relief of said locking tab extension of said first body member disengages from said peripheral edge of said side orifice of said second body member when a compression is applied between said first and second body members.

11. The device of claim 10, wherein a force applied to said locking tab extension of said first body member through said side orifice of said second body member will deform said semi-flexible finger of said first body member, allowing said locking tab extension of said first body member to leave said side orifice of said second body member.

12. The device of claim 11, wherein said side orifice of said second body member is enlarged to accommodate the finger of a user, where said force applied to said locking tab extension of said first body member through said side orifices of said second body member can be achieved directly by the finger of the user.

13. The two-piece electrical connecting device for temporarily connecting an electrical plug to an electrical wall socket, said device comprising:

(a) an electrical wall socket cover having a front surface and a plurality of orifices formed therethrough for the mating of said plug to said electrical wall socket, said socket cover having at least one semi-flexible finger extending substantially perpendicular from said front surface, said finger having at least one side surface, wherein said side surface has a locking tab extension protruding therefrom;

(b) a plug body having at least one substantially planar face surface with at least one finger receptacle orifice therethrough, said receptacle orifice being so formed as to allow for the passage of said socket cover semi-flexible finger and said locking tab extension therethrough; and, (c) at least one side orifice formed within the side of said plug body, said side orifice intersecting said finger receptacle orifice, and said orifice being at least as large as said locking tab.

14. The device of claim 13, wherein said locking tab extension protruding from said semi-flexible finger of said socket cover interferes with the passage of said semi-flexible finger into said finger receptacle orifice of said plug body, said interference being removed by the deformation of said semi-flexible finger in a direction opposite said locking tab extension, said deformation creating a spring bias within said semi-flexible finger, causing said locking tab extension of said socket cover to enter said side orifice of said plug body as said semi-flexible finger of said socket cover is advanced within said finger receptacle orifice of said plug body.

15. The device of claim 13, wherein said socket cover is affixed to a wall by a plurality of attachment screws.

* * * * *